US006411255B2

(12) United States Patent
Roederer

(10) Patent No.: US 6,411,255 B2
(45) Date of Patent: Jun. 25, 2002

(54) REFLECTOR ANTENNA COMPRISING A PLURALITY OF PANELS

(75) Inventor: Antoine Roederer, Noordwijk (NL)

(73) Assignee: Agence Spatiale Europeenne, Paris (FR)

( * ) Notice: Subject to any disclaimer, the term of this patent is extended or adjusted under 35 U.S.C. 154(b) by 0 days.

(21) Appl. No.: 09/798,896

(22) Filed: Mar. 6, 2001

(30) Foreign Application Priority Data

Mar. 10, 2000 (FR) ..... 00 03082

(51) Int. Cl.[7] ..... H01Q 3/22
(52) U.S. Cl. ..... 342/371; 343/832; 342/373
(58) Field of Search ..... 342/371, 373; 343/755, 761, 832, 839, 840, 834

(56) References Cited

U.S. PATENT DOCUMENTS

| | | | | |
|---|---|---|---|---|
| 3,599,218 A | * | 8/1971 | Williamson et al. | 343/840 |
| 5,115,248 A | | 5/1992 | Roederer | 342/373 |
| 5,202,700 A | * | 4/1993 | Miller | 343/840 |
| 5,598,173 A | * | 1/1997 | Lo Forti et al. | 343/781 R |
| 5,936,592 A | * | 8/1999 | Ramanujam et al. | 343/853 |
| 5,990,842 A | * | 11/1999 | Lo Forti et al. | 343/756 |
| 6,201,508 B1 | * | 3/2001 | Metzen et al. | 343/778 |
| 6,266,024 B1 | * | 7/2001 | Ramanujam et al. | 343/781 CA |

FOREIGN PATENT DOCUMENTS

| | | | |
|---|---|---|---|
| DE | 1 132 987 | 7/1962 | |
| EP | 0 639 035 | 2/1995 | H04Q/7/36 |
| EP | 0 928 042 | 7/1999 | H01Q/3/46 |

OTHER PUBLICATIONS

Hariu, K. et al., Pattern Correction in Large Deployable Reflector Antennas With Phased Array Feed, IEEE Antennas and Propagation Society International Symposium 1997, vol. 2, Jul. 13–18, 1997, pp. 844–847.

Hassan, M.A., Antenna Surface Modeling by Rectangular Plates, 1983 International Symposium Digest, Antennas and Propagation, vol. 1, May 23–26, 1983, pp. 99–102.

Sikora L.J., et al., Flapstm Reflector Antennas Features Well Suited For Commercial and Dual–Use Applications, Proceedings of the National Telesystems Conference, US, New York, Jun. 16, 1993, pp. 233–238.

French search report dated Oct. 16, 2000.

* cited by examiner

*Primary Examiner*—Dao Phan
(74) *Attorney, Agent, or Firm*—Sughrue Mion, PLLC

(57) ABSTRACT

A reflector antenna comprising a plurality of plane panels assembled edge to edge to form a non-plane surface constituting an approximation to a reference surface, and a beam-forming device generating a beam-forming function for an array of antenna elements coupled to said panels. The beam-forming function presents at least one surface error correction term to compensate at least in part for the difference between the surface constituted by the assembled panels and the reference surface. In a variant the manner for compensating for the error can be disposed on the panels.

11 Claims, 1 Drawing Sheet

REFLECTOR ANTENNA COMPRISING A PLURALITY OF PANELS

The present invention relates to a reflector antenna suitable for use in transmit and/or receive mode, and in particular suitable for use on board geostationary communications satellites.

BACKGROUND OF THE INVENTION

Such satellites have large deployable reflectors of dimensions that commonly reach 10 meters (m) to 15 m. They are powered by feeder arrays of large dimensions. In order to approximate to a parabolic profile, the reflectors are organized in a meshed array which is put into place and held under tension by a complex system that implements cables. One such parabolic and deployable reflector is described in U.S. Pat. No. 4,811,034 (TRW).

As an indication, a reflector having a diameter of 12 m using that technology weighs about 100 kilograms (kg) and costs about 10,000,000 Euros.

OBJECTS AND SUMMARY OF THE INVENTION

An object of the present invention is to provide a reflector antenna suitable for approximating a reference surface such as a parabolic surface from a much smaller number of panels.

The idea on which the invention is based is to provide electronic correction, at least in part, for the approximation to the reference surface that is due to implementing multiple panels.

The invention thus provides a reflector antenna characterized in that it comprises a plurality of panels assembled edge to edge to form a non-plane surface constituting an approximation to a reference surface, and a beam-forming device generating a beam-forming function for an array of antenna elements coupled to said panels, and in that said beam-forming function presents at least one surface error correction term for compensating at least in part the difference between the surface constituted by the assembled panels, in particular plane panels, and said reference surface, in particular a parabola, and/or in that at least some of said panels have reflector elements provided with fixed or variable compensation means for compensating said difference, at least in part.

The panels can be made of carbon fiber or they can be constituted by a mechanically tensioned wire mesh or indeed mesh under mechanical tension that is covered in metal. They can also be constituted by membranes.

In a variant, the panels can be reflecting arrays, each constituted by an array of such reflecting elements.

At least some of said reflecting elements can be coupled to phase shifters that give rise to fixed delays and/or to phase shifters giving rise to variable delays, and constituting said compensation means.

At least some of the reflecting elements can present two elements that are polarized perpendicularly relative to each other and interconnected by a transmission line that gives rise to a fixed delay.

At least some of the reflector elements can present two elements that are polarized perpendicularly relative to each other and that are interconnected by a phase shifter giving rise to a variable delay.

The panels can be plane and rigid. In a variant, the panels which are, for example, plane, can be flexible and subjected to mechanical tension, e.g. by means of a cable, so as to give them a shape that is not plane.

Beam formation can be implemented in baseband or at intermediate frequency. The beam-forming device can be analog, digital, or of combined analog-and-digital technology.

BRIEF DESCRIPTION OF THE DRAWING

The invention will be better understood on reading the following description given by way of non-limiting example and with reference to the accompanying drawing, in which.

MORE DETAILED DESCRIPTION

Figure 1:
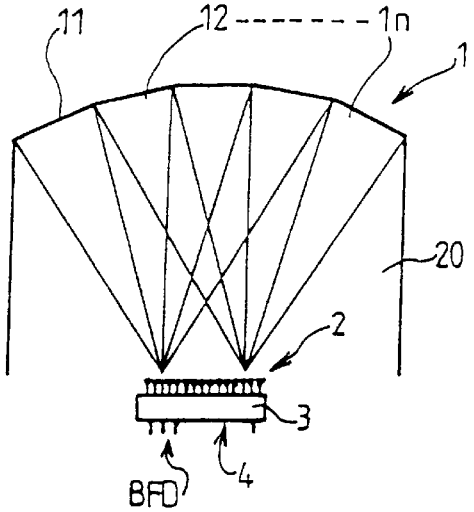
FIG. 1 shows a first embodiment of the invention.
Figure 2:
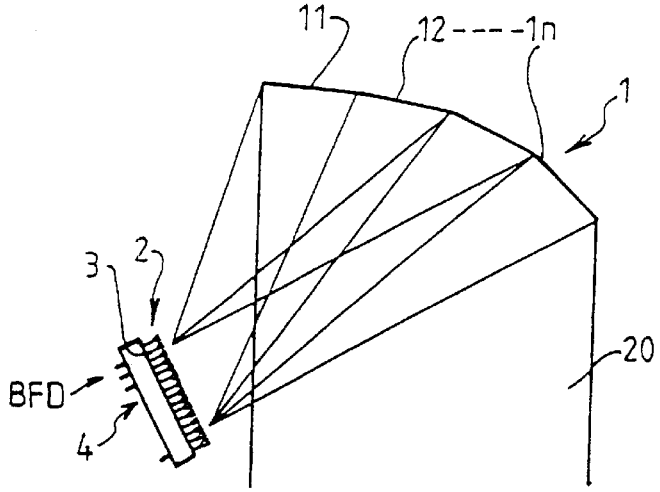
FIG. 2 shows a second embodiment of the invention.
Figure 3:
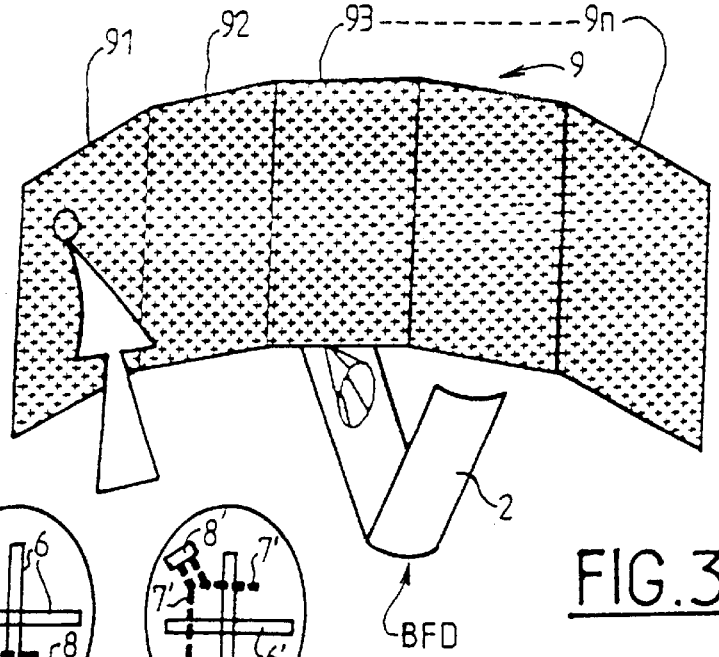
FIG. 3 shows a preferred embodiment of the invention, with variants being illustrated in FIGS. 4*a* and 4*b*.

FIG. 1 shows a reflector antenna 1 presenting a plurality of plane panels 11, 12, . . . , in that are hinged to one another to form an array in one or two dimensions to constitute an approximation to a parabola. The array is associated with a beam-forming device BFD having input/output (I/O) terminals 4, an electronic circuit 3 that operates in conventional manner for transmission and/or reception and that serves to generate a beam-forming function, and an antenna array 2 which feeds the antenna 1 during transmission and/or reception. FIG. 1 shows a configuration that is symmetrical, while FIG. 2 shows asymmetrical feed in which the beam-forming device BFD is offset so as to lie outside the coverage zone 20 of the transmit/receive antenna 1.

The beam-forming device can be of the type described in U.S. Pat. No. 5,115,248 granted to the Applicant company and entitled "Multibeam antenna feed device".

The panels 11, 12, etc. . . . can be thin carbon fiber panels. Each of them can be constituted by a membrane, or by wire mesh under tension, or by a mesh under tension and covered in metal.

In receive mode, the reflector 1 picks up the incident electrical power via the antennas of the beam-forming device BFD which operates at radio frequency (RF), or at intermediate frequency (IF), or indeed in baseband. The circuit 3 of the beam-forming device BFD serves both to perform the beam-forming function proper and to compensate for surface errors which are due to using a succession of panels, and in particular plane panels, thereby constituting only an approximation to the desired parabolic shape.

In transmit mode, operation is symmetrical, the beam-forming array 3 being capable in conventional manner of operating equally well in transmission and in reception as can the antenna array 2.

The reflector panels can be replaced, as shown in FIG. 2, by arrays of reflectors 91, 92, 93, . . . , 9n, each constituted by an array of interconnected elements. Such reflector array antennas are described, for example, in the article by J. Huang entitled "Review and design of printed reflect-array antennas", published on pages 483 to 490 of the report of the JINA 98 International Symposium on Antennas that was held in Nice in 1998, or indeed in U.S. Pat. No. 4,684,952 (Ball Corp.).

Each of the panels 91, 92, etc. . . . presents a plurality of active or passive reflector elements which can be implemented as printed circuits, for example, and which can be given focusing properties enabling the size of the feed array 2 to be reduced. The multiplicity of facets of such reflector arrays makes it possible to increase the passband of the antenna, given that the difference, expressed in wavelength, between the desired profile and that which is to be compensated is small.

Another advantage of using a plurality of panels of this type is that the power which is reflected directly and which results from parasitic radiation is reduced.

This is due to the fact that the angle of incidence from the antennas 2 on the facets is smaller than when using a single panel.

Each reflector panel in an array presents facets covered in reflecting elements which introduce a phase shift that can be adjusted in fixed or variable manner.

Figure 4A:
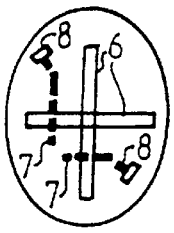
Figure 4B:
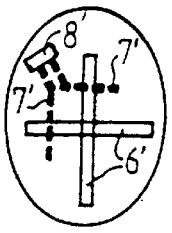

As shown in FIGS. 4*a* and 4*b*, a reflector element comprises a radiating element (printed dipole, etc. . . . ) 6, 6' connected to a transmission line 7, 7' which is terminated by a short circuit or a variable phase shifter 8, 8'. The length of the transmission line introduces a phase shift and it is adjusted as a function of the position of the element within the panel so as to reflect the incident energy with the desired phase so that the energy is focused in the desired manner.

When a variable phase shifter is implemented, the shape of the beam and aiming control can be determined dynamically, which is desirable when making synthetic aperture radars.

The elements can have single polarization or they can be disposed in two polarizations.

FIG. 4*a* shows elements 7 disposed in two orthogonal polarizations, each being fitted with a phase shifter 8 enabling signals of each polarization to be controlled independently.

FIG. 4*b* shows a configuration that is particularly advantageous for the reflector elements which present pairs of orthogonally polarized elements 6' coupled together by respective transmission lines 7' of length that is optimized as a function of the position of the element and of the shape desired for the beam and for its pointing. If variable phase shifters are included in the transmission lines, one advantage of such a configuration is to halve the number of phase shifters 8' that are required, thereby reducing cost and mass.

The idea on which the invention is based is thus using reflecting surface antennas made up of panels (generally plane so as to be easier to manufacture and deploy) approximating to a curved surface, e.g. a paraboloid, and then to compensate as well as possible for the effects of this approximation to a surface by performing electronic correction, either in the illuminating sources or by fixed or variable adjustments on reflector elements disposed on or integrated in the panels, or by combining both techniques.

When the reflector is made of reflecting surface panels (aluminum, carbon fiber, wire mesh), electronic correction is preferably performed at the illuminator for the reflector system. The illuminator is then constituted by an array of multiple sources of number and disposition that depend on the shape of the system and on the specified radiation beams. The field radiated by each of these sources when excited alone in the presence of the imperfect reflecting system is used for synthesizing excitation amplitudes and phases for the illuminating array so as to approximate as closely as possible to the specified beams. This synthesis is performed by conventional methods that are well known and applicable both in transmit mode and in receive mode (e.g. beam forming).

These excitations are implemented by conventional methods at microwave frequency, at IF, or digitally.

When the reflector is made of panels comprising antenna elements, e.g. dipoles, slots, or printed or multilayer microstrips, each of them is connected to a transmission line segment that includes a fixed or variable phase shifter.

The phase shifter can be connected to a short circuit which reflects power to the radiating element. The signal is thus phase-shifted twice and re-radiated at a phase that is optimized for compensating surface error and to form one or more specified beams.

The method of optimizing phases combines path correction techniques and synthesis techniques that are known in themselves, e.g. from the work "Handbook of antenna design" by A. W. Rudge et al., published by Peregrinus Ltd. in 1986 on behalf of IEEE (pp. 40 to 46).

In general, the objective to be achieved is a radiation pattern that is as close as possible to some imposed characteristic either on transmission or on reception, or indeed for radar, for go-and-return in transmission and in reception.

In the first two cases, reference is often made to a plane aperture perpendicular to the radiation axis of the antenna in which attempts are made to recreate amplitude and phase distribution that correspond via a Fourier transform to that of the desired pattern. (See for example The antenna design handbook by A. Rudge et al., 1986, Peter Pelegrinus Ltd., pp. 40 to 46.)

Page 468 of that work shows an antenna having two multisource reflectors with a parabolic reflector. The parabolic reflector could be replaced in the present invention by an assembly of reflecting plane facets.

Under such circumstances, synthesis could comprise the following:

a) correcting the path by compensating phase at said elements so as to restore the phase front that would have been produced by a parabolic reflector; and b) any beam scanning or synthesis technique making use of source excitation.

In another configuration, the phase shifter can be connected to another radiating element or to another port of the same element at orthogonal polarization. The signal is then phase-shifted only once and is re-radiated with optimized phase so as to compensate for surface error and form one or more specified beams. The advantage of this configuration is that it makes it possible to halve the number of phase shifters in certain dual-polarization applications, in particular for radar.

What is claimed is:

1. A reflector antenna comprising a plurality of plane panels assembled edge to edge to form a non-plane surface constituting an approximation to a reference surface, and a beam-forming device generating a beam-forming function for an array of antenna elements coupled to said panels, said beam-forming function presenting at least one surface error correction term to compensate at least in part for the difference between the surface constituted by the assembled panels and said reference surface.

2. An antenna according to claim 1, wherein the reference surface is a parabola.

3. An antenna according to claim 1, wherein the panels are made of carbon fiber.

4. An antenna according to claim 1, wherein the plane panels are rigid.

5. An antenna according to claim 1 wherein said panels comprise a wire mesh under tension.

6. An antenna according to claim 1 wherein said mesh is covered with a metallic material.

7. An antenna according to claim 1 wherein said beam forming device is symmetrically placed with respect to said plurality of plane panels.

8. An antenna according to claim 1 wherein said beam forming device is asymmetrically placed with respect to said plurality of plane panels.

9. An antenna according to claim 1 wherein each plane panel further comprises an array of reflector elements on the surface thereof.

10. An antenna according to claim 9 wherein said reflector elements are passive reflectors.

11. An antenna according to claim 9 wherein said reflector elements are active radiating elements.

* * * * *